US006762358B2

(12) United States Patent
Iguchi et al.

(10) Patent No.: US 6,762,358 B2
(45) Date of Patent: Jul. 13, 2004

(54) WAVEFORM REPRODUCTION APPARATUS

(75) Inventors: Akira Iguchi, Inasa (JP); Toshio Yamabata, Hamamatsu (JP)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 10/339,105

(22) Filed: Jan. 8, 2003

(65) Prior Publication Data

US 2003/0131714 A1 Jul. 17, 2003

(30) Foreign Application Priority Data

Jan. 11, 2002 (JP) ..... 2002-004247

(51) Int. Cl.[7] ..... G10H 7/00
(52) U.S. Cl. ..... 84/604
(58) Field of Search ..... 84/600–607

(56) References Cited

U.S. PATENT DOCUMENTS 5,086,475 A 2/1992 Kutaragi et al.
5,284,080 A 2/1994 Noguchi et al.
5,321,198 A 6/1994 Suzuki et al.
5,463,183 A 10/1995 Konno
5,811,706 A 9/1998 Van Buskirk et al.
6,008,446 A 12/1999 Van Buskirk et al.
6,138,224 A 10/2000 Lisle ..... 711/206
6,525,254 B2 2/2003 Tsutsumi ..... 84/615

FOREIGN PATENT DOCUMENTS

JP 11-282465 10/1999
JP 2000-056763 2/2000

*Primary Examiner*—Jeffrey W. Donels
(74) *Attorney, Agent, or Firm*—Foley & Lardner LLP

(57) ABSTRACT

A waveform reproduction apparatus and process for carrying out waveform reproduction without delays. Waveform data expressing first and latter half portions of a musical tone waveform are stored on a storage device. In response to a tone generation start indicator, waveform data that express first half portions corresponding to the tone generation start indicator are successively read out and corresponding musical tone waveforms are formed. Following this, the waveform data that express latter half portions corresponding to the tone generation start indicator are successively read out and corresponding musical tone waveforms are formed. After the first half portions are successively read out and corresponding musical tone waveforms are formed, if the read-out of the waveform data that express the latter half portions corresponding to the tone generation start indicator is not completed in time, the formation of the musical tone waveforms is based on a specified segment set in the first half portion of the waveform data.

18 Claims, 9 Drawing Sheets

| Parameter Details | |
|---|---|
| Parameter | |
| Number of Splits | |
| Split 1 | Key range lower limit note number |
| | Key range upper limit note number |
| | Number of the waveform portion A for which the tone is generated in the key range |
| | Waveform portion A START ADDRESS |
| | Waveform portion A LOOP START ADDRESS |
| | Waveform portion A LOOP END ADDRESS |
| | Waveform portion A END ADDRESS |
| | Number of the waveform portion B for which the tone is generated in the key range |
| | Waveform portion B START ADDRESS |
| | Waveform portion B LOOP START ADDRESS |
| | Waveform portion B LOOP END ADDRESS |
| : | : |
| Split N | : |

13

| | Area and Control Group | Acquisition |
|---|---|---|
| 13a | Area for fetching the timbre parameters | Depends on each parameter |
| 13b | The flag Flag, which indicates the timbre state | 0: tone generation not possible<br>1: tone generation possible |
| 13c | The flag S Flag, which indicates the state of the waveform portion B for each split | 0: tone generation not possible<br>1: tone generation possible |

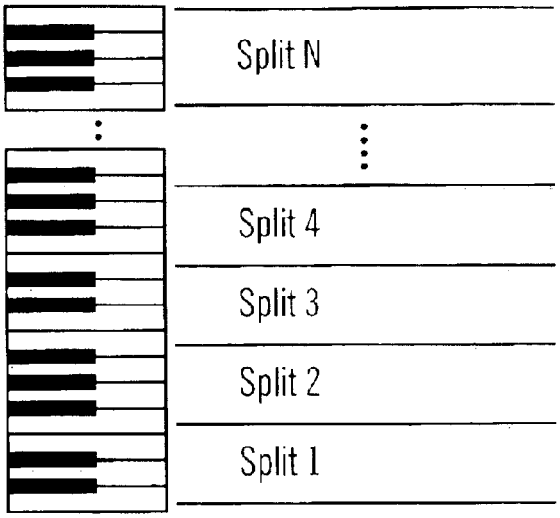

FIG. 5

| Parameter Details | |
|---|---|
| Parameter | |
| Number of Splits | |
| Split 1 | Key range lower limit note number |
| | Key range upper limit note number |
| | Number of the waveform portion A for which the tone is generated in the key range |
| | Waveform portion A START ADDRESS |
| | Waveform portion A LOOP START ADDRESS |
| | Waveform portion A LOOP END ADDRESS |
| | Waveform portion A END ADDRESS |
| | Number of the waveform portion B for which the tone is generated in the key range |
| | Waveform portion B START ADDRESS |
| | Waveform portion B LOOP START ADDRESS |
| | Waveform portion B LOOP END ADDRESS |
| : | : |
| Split N | : |

FIG. 6

WAVEFORM REPRODUCTION APPARATUS

RELATED APPLICATIONS

This application is based upon and claims the benefit of priority from the prior Japanese Patent Application No. JP2002-004247, filed Jan. 11, 2002, the entire contents of which are incorporated herein by reference.

BACKGROUND OF THE INVENTION

1. Field of the Invention

The present invention relates to a waveform reproduction apparatus and process with which waveform data that have been stored are read out and the waveforms are reproduced.

2. Description of Related Art

For some time, waveform reproduction apparatuses have been known in which waveform data that have been obtained by the sampling of musical tones are stored in a ROM. When a tone generation start indicator is received, the waveform data that have been stored in the ROM are successively read out and musical tones are reproduced. With this kind of waveform reproduction apparatus, a large number of musical tone waveforms are stored in order to obtain good quality musical tones for each kind of timbre covering the entire keyboard range. Another reason for storing a large number of musical tone waveforms is to represent changes in the strength of the tones and the like. There has been a tendency in recent years, together with the expanding transition to higher musical tone sound quality, for increasing the storage capacity for storing the waveform data. Such large capacity storage of the waveform data in a ROM increases the cost of the system. Waveform reproduction apparatuses that are furnished with disk systems such as flexible magnetic disk devices, hard disk devices and the like, have been proposed by Japanese Examined Patent Application Publication (Kokoku) No. Hei 01-001800 and Japanese Patent Publication No. 2671747. However, the access times of these memory devices are comparatively slow.

SUMMARY OF THE DISCLOSURE

Embodiments of the present invention provide a waveform reproduction apparatus and process with which a larger amount of musical tone waveform data can be stored on a hard disk and, when the generation of a musical tones has been indicated, for example, by the operation of a keyboard, the musical tone generation is started without delay. It is therefore possible to generate good quality musical tones.

According to embodiments of the present invention, the waveform reproduction apparatus and process of the present invention:

1) Stores the first half portion from the start of the generation of the musical tone waveform up to a specified time in memory that can be read out at a high speed and stores the latter half portion of the waveform in a large-capacity memory such as a hard disk and the like and it is configured such that the latter half portion is read out after the first half portion has been read out. When the read-out of the latter half portion does not occur in time, a specified or pre-determined segment that has been set in the first half portion is read out until the read-out of the latter half portion does occur. By this means, in those cases in which a large volume of waveforms are stored and there has been a start of tone generation by pressing a key and the like, the tone generation can be started immediately. Even in those cases in which the read-out of the latter half portion does not come in time, it is possible to generate the musical tone without errors such as the musical tone being cut off and the like.

2) In addition, a large number of musical tone waveforms are divided into first half portions and latter half portions which are respectively stored on a hard disk. The waveform of the musical tone that has been selected by means of timbre selection and the like is transmitted to the RAM and the musical tone is formed by the waveform data that are read out from the RAM. When the transmission is carried out, first all of the first half portions are transmitted and then the latter half portions are transmitted. By this means, in those cases in which a large number of waveforms are stored and the timbre selection is done and the musical tones for that timbre are generated immediately, it is possible to reduce the time required to put the apparatus in a state in which the tones can be generated.

3) In addition, when all of the first half portions are stored in the high-speed memory and the latter half portions are transmitted from the hard disk to that memory, the latter half portion waveform data that correspond to the tone which is indicated by the key pressing signal and the like are transmitted with priority. By this means, the rapid read-out of the latter half portion of the musical tone for which the tone generation start indicator is received becomes possible and a musical tone having a natural link between the first half portion and the latter half portion can be obtained.

These and other features, and advantages of embodiments of the invention will be apparent to those skilled in the art from the following detailed description of embodiments of the invention, when read with the drawings and appended claims.

BRIEF DESCRIPTION OF THE DRAWINGS

FIG. 5 depicts each key range (split) in which the respective waveforms for each key range are stored, according to embodiments of the present invention;

FIG. 6 is a drawing that depicts details of the timbre parameters in the split that is depicted in FIG. 5, according to embodiments of the present invention;

DETAILED DESCRIPTION OF EMBODIMENT OF THE INVENTION

An explanation will be given below of preferred embodiments of the present invention.

Figure 1:
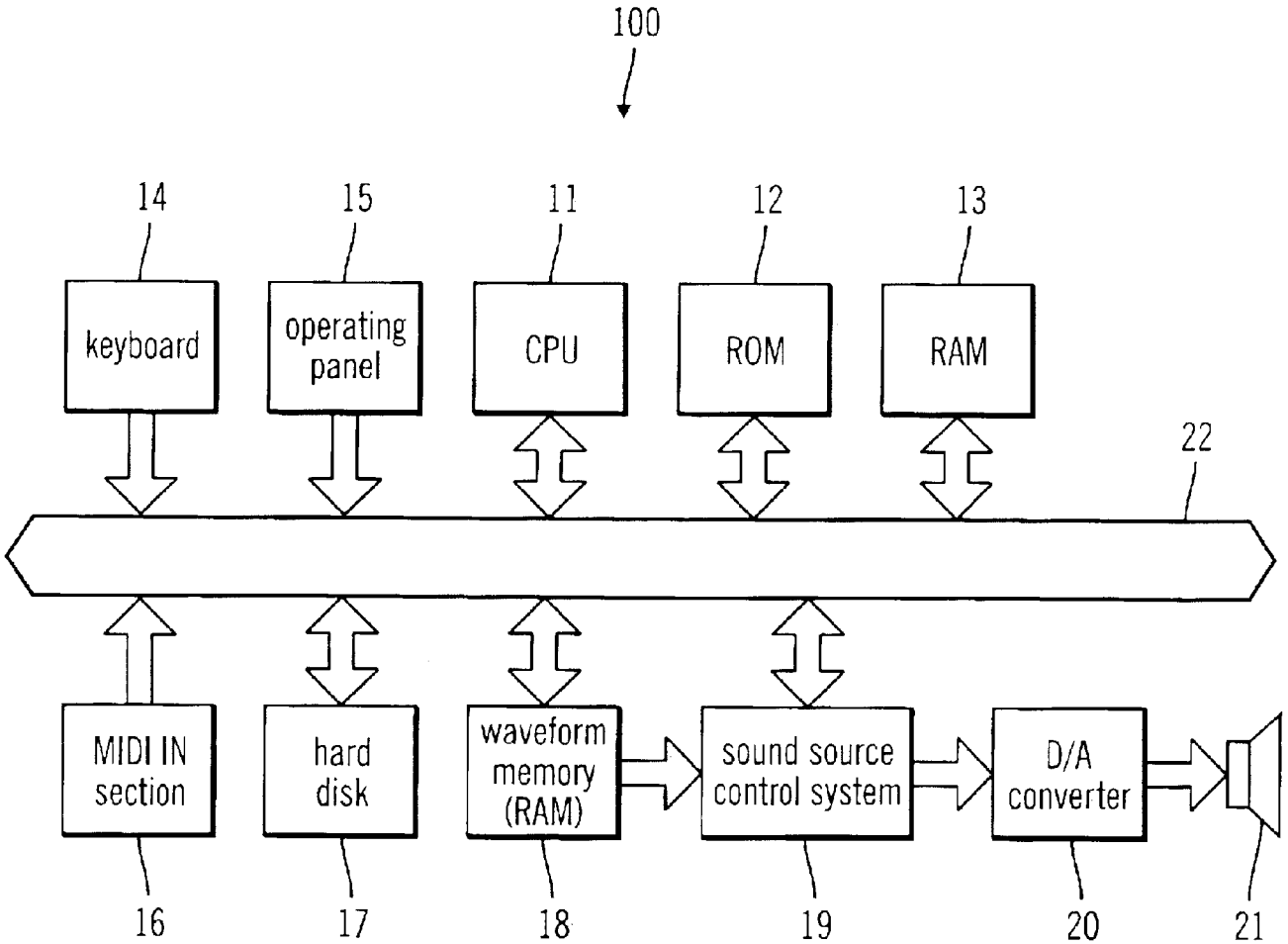
FIG. 1 is a block diagram of the circuit of an electronic musical instrument that incorporates a waveform reproduction apparatus of one preferred embodiment of the present invention.

FIG. 1 is a block diagram of the circuit of an electronic musical instrument in which the waveform reproduction apparatus of one preferred embodiment of the present invention may be employed. The electronic musical instrument 100 is furnished with the CPU 11, the ROM 12, the RAM 13, the keyboard 14, the operating panel 15, the MIDI IN section 16, the hard disk 17, the waveform memory (RAM) 18, the sound source control system 19, and the D/A converter 20 which are mutually connected to each other through the bus 22. In addition, the D/A converter 20 is connected to the speaker 21. The information that is input from the keyboard 14, includes the NOTE ON information (including the ON velocity information), which is the tone generation start indicator, and the NOTE OFF information (including the OFF velocity information), which is the tone generation stop indicator. In addition, the information that is input from the MIDI IN section 16, includes, as described before, the NOTE ON information and the NOTE OFF information as well as the program change information, which is the timbre indicator, and the like.

The CPU 11 controls the entire electronic musical instrument 100 by reading out the program that is stored in the ROM 12. Incidentally, the distinctive role of the CPU 11 in this preferred embodiment will be discussed later. The program that is executed by the CPU 11, as well as data, are stored in the ROM 12.

The RAM 13 is used as the operating area by the CPU 11. In addition, the parameters and variables for the sound source control, which will be discussed later, are stored in the RAM 13.

The keyboard 14, by means of the operation of the keys by the performer, outputs the NOTE ON information and the NOTE OFF information that corresponds to those keys.

As will be discussed in detail later, the operating panel 15 is furnished with a plurality of operators for the selection of the timbre and outputs the program changes, which are the timbre selection data.

The hard disk 17 corresponds to one example of the first storage section of the present invention. Hard disk 17 stores at least the waveform data that express the latter half portion of the musical tone waveform from among the waveform data that express the musical tone waveform. According to some embodiments of the present invention, the waveform data that express both the first half portions and the latter half portions of a plurality of the musical tone waveforms are stored on the hard disk 17.

The waveform memory 18 corresponds to one example of the second storage section of the present invention and stores the waveform data that express the above mentioned musical tone waveforms. It is a storage section with which a faster read-out is possible than with the hard disk 17. Specifically, the waveform memory 18 receives the transmission of the waveform data that express both the first half portions and the latter half portions of a plurality of the musical tone waveforms.

The sound source control system 19 assumes the role of the waveform reproduction means of the present invention. The system receives the NOTE ON information for the waveform data that express the first half portions of the musical tone waveforms in the waveform memory 18, starting the reproduction. The system also receives the NOTE OFF information and stops the reproduction. At those times during the reproduction that the transmission from the hard disk 17 to the waveform memory 18 of the waveform data that express the latter half portion of the musical tone waveforms is not completed in time, the system repeatedly reproduces a musical tone waveform based on waveform data in a specified segment of the waveform data that corresponds to the first half portion that has been stored in the waveform memory 18. This repetition continues until it becomes possible for the waveform reproduction of the latter half portion that corresponds to the waveform data that express the first half portion that has been stored in the waveform memory 18.

In further detail, the sound source control system 19 receives the NOTE ON information that is specific to the musical tone waveform to be reproduced. The sound source control system 19 then reproduces the musical tone waveform based on the waveform data that express that musical tone waveform.

Specifically, the sound source control system 19 reads out and transmits to the D/A converter 20 the waveform data from the waveform memory 18. At the same time it carries out the control of the pitch changes, envelope and the like from the waveform memory 18 in accordance with the directions from the CPU 11. In addition, the sound source control system 19 sets the parameters START ADDRESS, LOOP START ADDRESS, LOOP END ADDRESS, JUMP ORIGIN ADDRESS, and JUMP DESTINATION ADDRESS by means of the CPU 11.

When the sound source control system 19 receives the NOTE ON information from the keyboard 14 or the MIDI IN section 16, the system starts the waveform reproduction from the START ADDRESS. It then performs a loop reproduction between the LOOP START ADDRESS and the LOOP END ADDRESS. In addition, when the reproduction address has reached the JUMP ORIGIN ADDRESS, it shifts to the JUMP DESTINATION ADDRESS.

In addition, when the CPU 11 receives the timbre selection information from the MIDI IN section 16 or the operating panel 15, the timbre parameters and the waveform data for the corresponding waveform are set in the dedicated transmission circuit (DMA), which is not depicted in the drawing. Thus, they can be transmitted from the hard disk 17 to the RAM 13 and the waveform memory 18, respectively. The dedicated transmission circuit transmits the stored contents of the hard disk 17 at a high speed to the RAM 13 and the waveform memory 18 in conformance with these settings.

The waveform data transmission will now be discussed in more detail. The following process is performed for a range of a plurality of musical tone waveforms. First, from among waveform data that express the plurality of musical tone waveforms, only the waveform data that express the first half portions of the plurality of musical tone waveforms is transmitted to the waveform memory 18. Then, for the same range of the plurality of musical tone waveforms, the waveform data that express the latter half portions of the plurality of musical tone waveforms are transmitted to the waveform memory 18.

In this manner, no matter which of the keys of the keyboard 14 is pressed, it is possible to immediately carry out the reproduction of the waveform that corresponds to the key that has been pressed. In addition, it is also possible to immediately carry out the reproduction of the waveform that corresponds to the NOTE ON information that has been input from the MIDI IN section 16.

In further detail, the fact that the NOTE ON information has been received from the sound source control system 19 is received by the CPU 11. In those cases where the transmission to the waveform memory 18 of the waveform data that express the latter half portion of the musical tone waveform that corresponds to that NOTE ON information has not been completed, such waveform data is transmitted with priority. In this manner, because such waveform data that express the latter half portion of the musical tone waveform (corresponding, for example, to a pressed key of the keyboard 14) are transmitted with priority, the time required for switching over to the latter half portion of the reproduction of the musical tone waveform that corresponds to that key is reduced.

The D/A converter 20 converts the digital signal that has been output from the sound source control system 19 to an analog signal. The converted analog signal is input to the speaker 21 and, by this means, the musical tone is emitted from the speaker 21.

Figure 2:
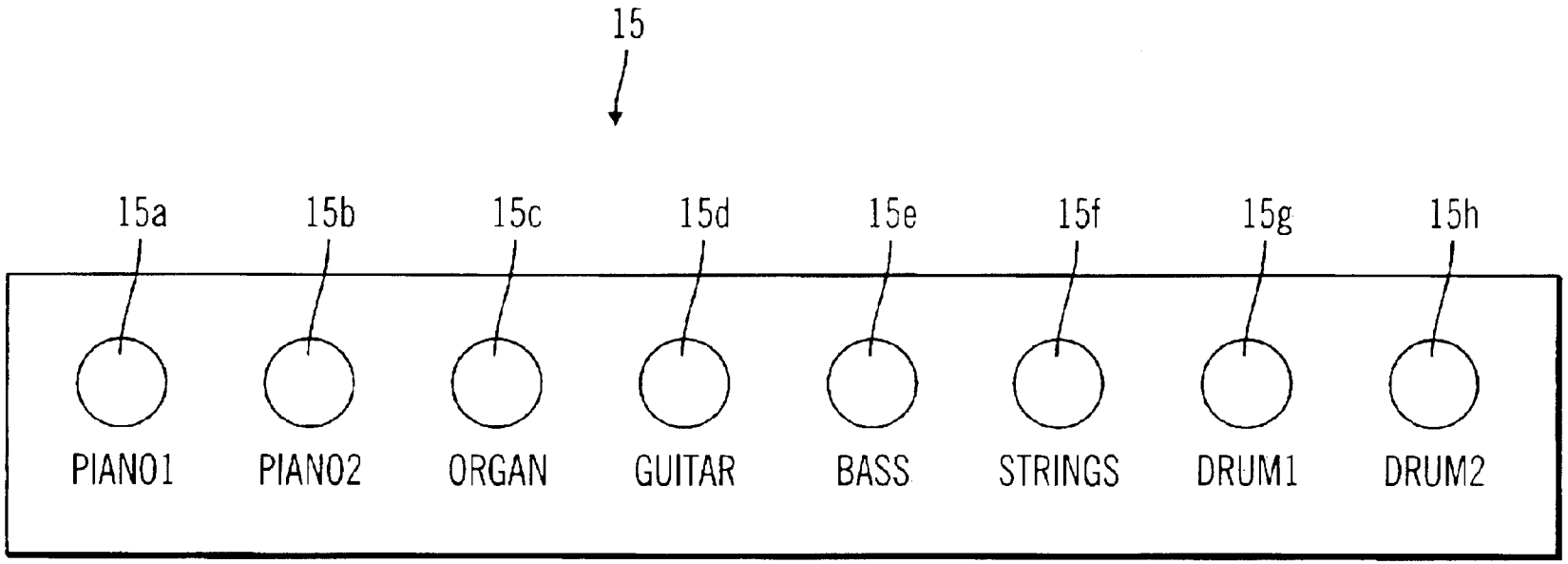
FIG. 2 is a drawing that depicts the operating panel depicted in FIG. 1, according to embodiments of the present invention.

FIG. 2 is a drawing that shows in more detail the operating panel 15 that is depicted in FIG. 1. The operating panel 15 that is depicted in FIG. 2 is furnished with the operators 15*a*, 15*b*, 15*c*, 15*d*, 15*e*, 15*f*, 15*g*, and 15*h*, which correspond respectively to each of the timbres Piano 1, Piano 2, Organ, Guitar, Bass, Strings, Drum 1, and Drum 2. Each of the operators 15*a*, 15*b*, 15*c*, 15*d*, 15*e*, 15*f*, 15*g*, and 15*h* has an LED display device built in. When a certain operator is operated, the timbre that corresponds to the operator that has been operated is selected. As discussed in detail later, when the timbre selection information from the operators 15*a* through 15*h* or the MIDI IN section 16 is received, the LED display device for the operator flashes until the tone generation becomes possible and lights steadily when the tone can be generated.

Figures 3, 4:
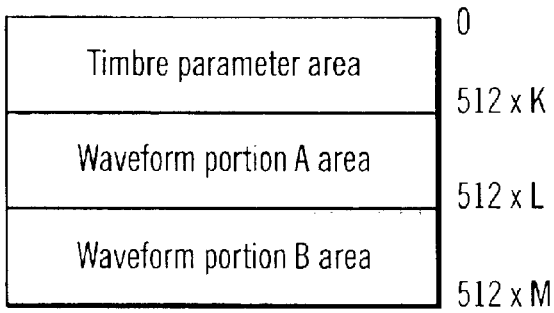
FIG. 3 is a drawing that depicts the structure of a RAM depicted in FIG. 1, according to embodiments of the present invention.
FIG. 4 is a drawing that depicts the structure of a timbre file, according to embodiments of the present invention.

FIG. 3 is a drawing that depicts the structure of the RAM 13 that is depicted in FIG. 1. The area 13*a* of the RAM 13 that is depicted in FIG. 3 is the area in which the timbre parameters are stored and the timbre parameters that have been transmitted from the hard disk 17 are stored there. The number of possible values for a timbre parameter is dependent on the type of timbre parameter. In addition, the area 13*b* is an area for storing the flag "Flag" that indicates the state of the timbre. Two values are possible for the flag Flag: 0 (tone generation is not possible) and 1 (tone generation is possible). Also, the area 13*c* is the area for storing the flag "S Flag" that indicates the state of the latter half portion of musical tone waveform for each split (described as the waveform portion B), which will be discussed later. Two values are possible for each flag S Flag: 0 (tone generation is not possible) and 1 (tone generation is possible).

FIG. 4 is a drawing that depicts the structure of the timbre file. The timbre file comprises three types of data: timbre parameters, waveform portion A waveform data, and waveform portion B waveform data for each timbre. The respective data are stored in areas of 512 byte units, which are the sector units with which the read-out from the hard disk can be carried out at a high speed. Here, the timbre parameters are stored from 0 to 512×K bytes in each area, the waveform portion A from 512×K bytes to 512×L bytes, and the waveform portion B from 512×L bytes to 512×M bytes (it should be noted that K, L, and M are integers).

FIG. 5 depicts each key range ("split") in which the respective waveforms for each key range are stored. Here, the case in which the entire key range has been divided by N is depicted and the waveform portions A and waveform portions B are stored for each split. The number of divisions and division positions differ depending on the timbre.

FIG. 6 is a drawing that depicts the details of the timbre parameters in the split 1 that is depicted in FIG. 5. Specifically, the drawing depicts the lower limit and upper limit note numbers for the key range for the split 1, the number of the waveform portion A (which is the first half portion of a musical tone waveform that is generated in that key range), the START ADDRESS of the waveform portion A, the LOOP START ADDRESS of the waveform portion A, the LOOP END ADDRESS of the waveform portion A, and the END ADDRESS of the waveform portion A. The drawing further depicts the number of the waveform portion B (which is the latter half portion of a musical tone waveform that is generated in that key range), the START ADDRESS of the waveform portion B, the LOOP START ADDRESS of the waveform portion B, and the LOOP END ADDRESS of the waveform portion B. According to embodiments of the present invention, the timbre parameters in the splits 2 through N are the same as in the case of the timbre parameters in the split 1. In addition, each of the addresses of the timbre parameters is stipulated as an offset value from the addresses at which the transmissions of the waveform portions A and B start in the waveform memory 18.

The waveform portion A of the splits 1 through N and the waveform portion B of the splits 1 through N are respectively stored in number order in the waveform portion A area and the waveform portion B area in FIG. 4, as previously discussed.

Figure 7:
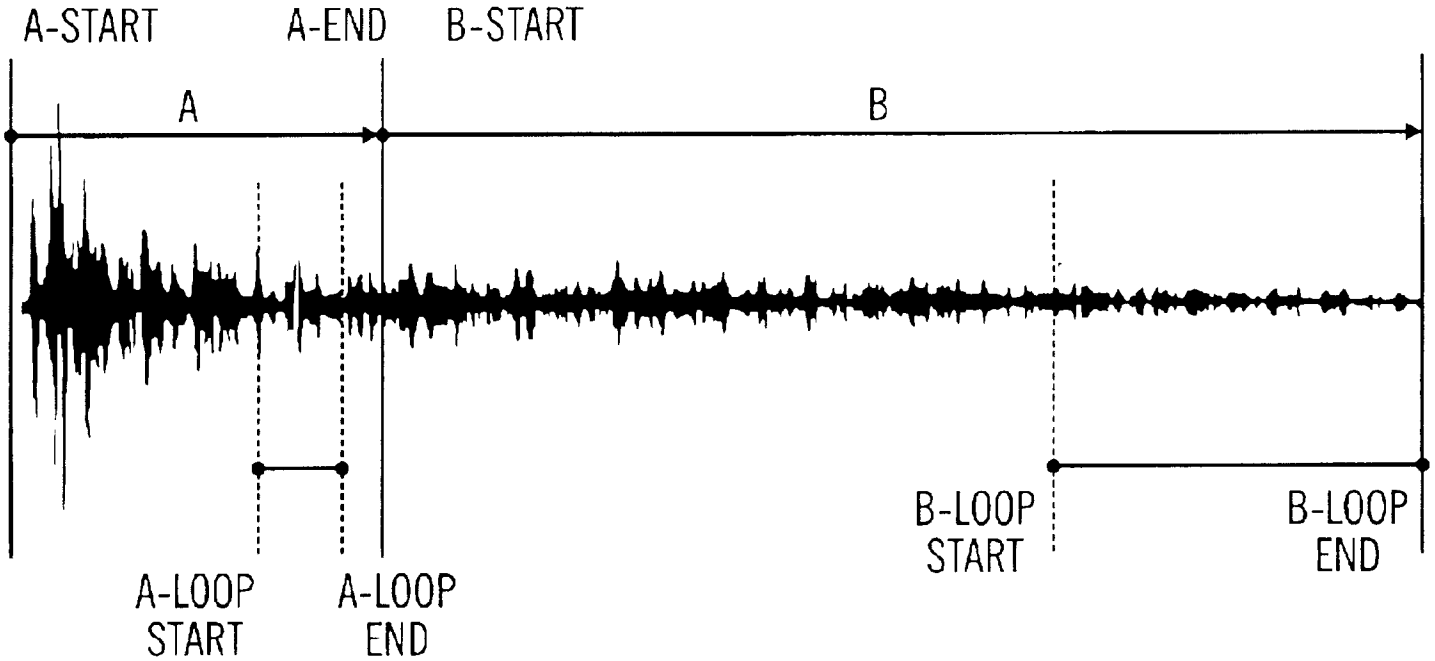
FIG. 7 is a drawing that depicts a waveform of a particular timbre, according to embodiments of the present invention.

FIG. 7 depicts the waveform of a particular timbre. FIG. 7 also depicts the START ADDRESS of the waveform portion A (the A-START), the LOOP START ADDRESS of the waveform portion A (the A-LOOP START), the LOOP END ADDRESS of the waveform portion A (the A-LOOP END), the END ADDRESS of the waveform portion A (the A-END), the START ADDRESS of the waveform portion B (the B-START), the LOOP START ADDRESS of the waveform portion B (the B-LOOP START), and the LOOP END ADDRESS of the waveform portion B (the B-LOOP END). These addresses will be discussed later.

Next, an explanation will be given regarding the operation of the waveform reproduction apparatus and process of this preferred embodiment. When a new timbre has been selected in the waveform reproduction apparatus, all of the parameters for that timbre are transmitted to the RAM 13. Following this, the waveform data are transmitted to the waveform memory 18. Specifically, first all of the first half portions of the waveform data of the split are transmitted. Then, the latter half portions of the waveform data of the split are transmitted. At the point in time when the transmission of the first half portions has been completed and the transmission of the latter half portions has started, tone generation simultaneously becomes possible. From that point on, in conformance with the NOTE ON information that has been input, the tone generation in accordance with the read-out of the first half portion of the waveform data that correspond to that NOTE ON information is started.

In those cases where the read-out of the first half portion has advanced up to a specified position and the latter half portion is already being transmitted to the waveform memory 18, the read-out of the latter half portion starts after the conclusion of the read-out of the first half portion. However, when this is not the case, in other words, in those cases where the transmission of the latter half portion has not been carried out, a specified segment of the first half portion (between the A-LOOP START and the A-LOOP END depicted in FIG. 7) is read out and reproduced. A detailed explanation of this operation will be given with reference to the flowcharts of FIG. 8, FIG. 9, and FIG. 11.

Figure 8:
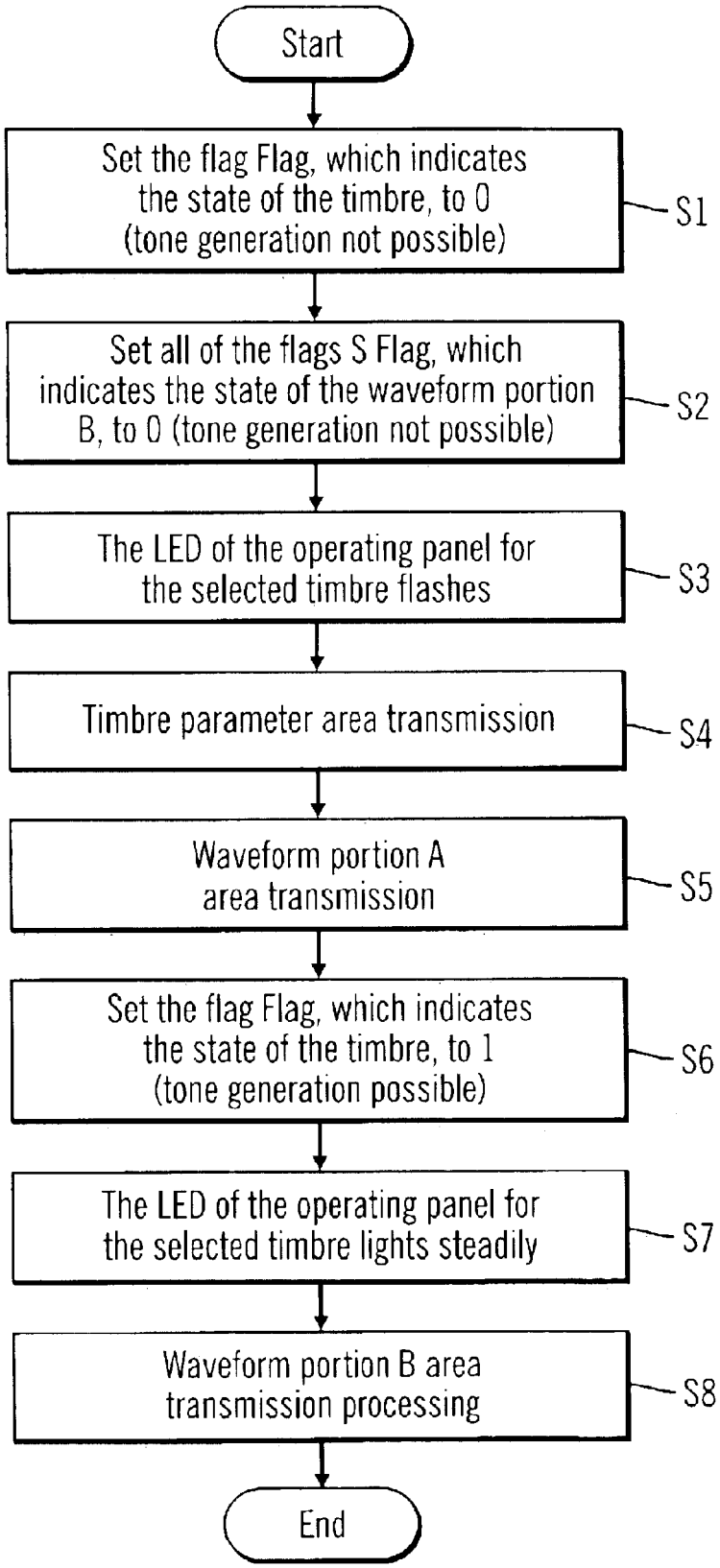
FIG. 8 is a flowchart of a timbre selection processing routine, according to embodiments of the present invention.
Figure 9:
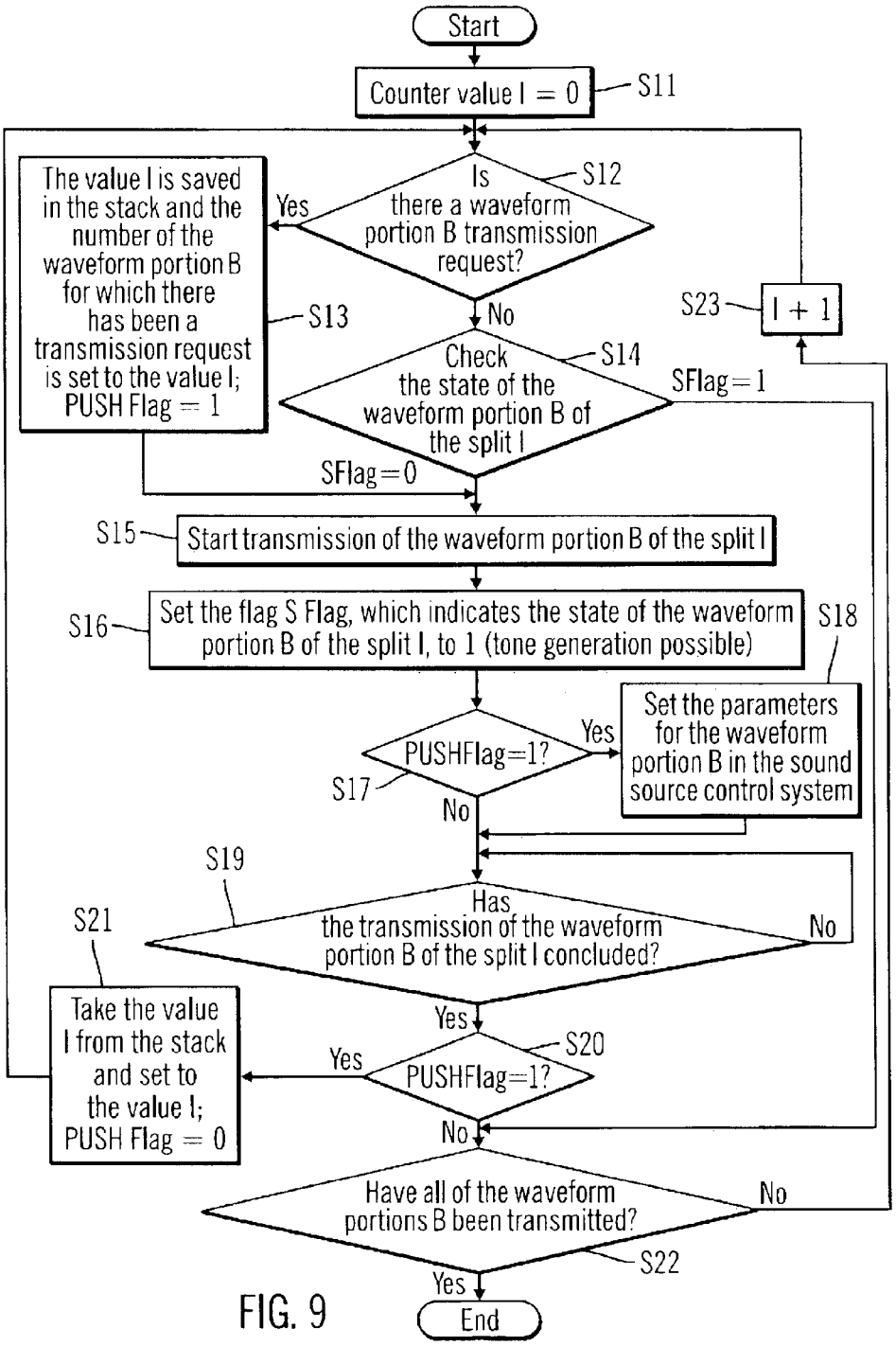
FIG. 9 is a flowchart of a read-out processing routine for a waveform portion B area, according to embodiments of the present invention.

FIG. 8 is a flowchart of the timbre selection processing routine. This routine is started in those cases where the selected timbre file does not exist in the RAM 13 and the waveform memory 18.

First, in Step S1, the flag Flag, which indicates the state of the timbre (refer to FIG. 3), is set to 0 (tone generation not possible). Next, in Step S2, the flag S Flag, which indicates the state of the Waveform portion B (refer to FIG. 3), is set to 0 (tone generation not possible). In addition, in Step S3, on the operating panel 15 the LED display device for the timbre that has been selected flashes.

In Step S4, the transmission of the timbre parameters from the hard disk 17 is directed. Following the conclusion of the transmission of the timbre parameters, the transmission of the waveform portion A is directed (Step S5). Here, each of the addresses of the timbre parameters may be an offset value from the addresses at which the transmissions of the waveform portions A start in the waveform memory 18. Since musical tone generation becomes possible when the waveforms for the waveform portion A of all of the splits have been transmitted to the waveform memory 18 (Step S6), the LED that corresponds to the timbre that has been selected shifts from flashing to a steady lit state when this condition has been met (Step S7). As a result of the above-described process, the timbre parameter area is stored in the RAM 13 and the waveform portion A is stored in the waveform memory 18.

Next, in Step S8, the transmission of the waveform portion B is carried out. An explanation of the details will be given with reference to the flowchart of FIG. 9. If the read-out of the Waveform portion A is not started by the input of the NOTE-ON information, the transmission of the waveform portion B is carried out in the split number order. However, in those cases where the transmission of the waveform portion B has not yet concluded and the read-out of the waveform portion A has been started, the transmission of the waveform of the waveform portion B for the split that corresponds to that key is carried out with priority.

A counter is used to step through the splits 1 through N. The current value of the counter value I represents the number of the split currently being processed. In Step S11, the counter value I is set to 0 and the process advances to Step S12. In Step S12, it is determined whether or not there has been a waveform portion B transmission request. (Incidentally, an explanation regarding the processing of the transmission request will be given at Step S33 of FIG. 11, which will be discussed later.) When it is determined that there has been a waveform portion B transmission request, the routine advances to Step S13. In Step S13, in order to process the waveform portion B transmission request, the counter value I is saved in the stack, and the number of the waveform portion B for which there has been a transmission request is set to the counter value I. In addition, the PUSH Flag, which indicates the saving of the counter value I in the stack, is set to 1 and the routine advances to Step S15, which will be discussed later.

On the other hand, when, in Step S12, it is determined that there has not been a waveform portion B transmission request, the routine advances to Step S14. In Step S14, the state of the waveform portion B of the split I is checked. That is to say, it is determined whether tone generation is possible or not (whether the S flag is 1 or not). Here the "S flag" is "the S Flag that corresponds to the waveform portion B of the split for which there has been a transmission request." When it is determined that the flag S Flag is 1, the routine advances to Step S22, which will be discussed later. On the other hand, when it is determined that the flag S Flag is 0, the routine advances to Step S15.

In Step S15, the hard disk is directed to prepare for the start of transmission and a preparation completion signal from the hard disk is awaited. A preparation completion signal is returned when the hard disk finishes the preparation, i.e., moving the head to the transmission start address (sector). When the preparation completion signal is input, the start of transmission is directed to the DMA in Step 16 and the S Flag is set. The value to which the S Flag is set is 1. In this manner, when the transmission of the waveform portion B is started, the flag S Flag is immediately set to 1, which indicates that the waveform portion B tone generation is possible. Next, the routine advances to Step S17.

Figure 10:
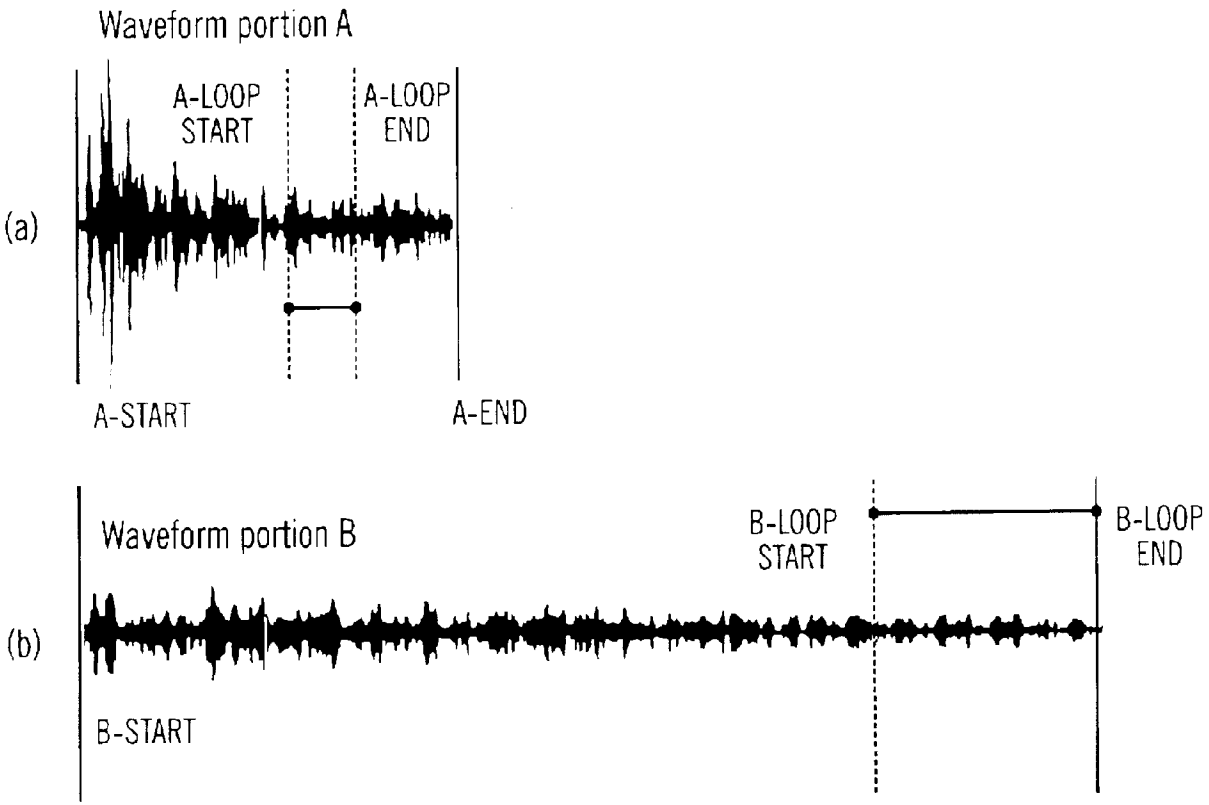
FIG. 10 is a drawing that depicts a waveform portion A and waveform portion B for setting the waveform parameters, according to embodiments of the present invention.

In Step S17, it is determined whether or not the PUSH Flag is 1. When it is determined that the PUSH flag is 1, the routine advances to Step S18 and when it is determined that the PUSH flag is 0, the routine advances to Step S19. In Step S18, the parameter With which the read-out of the waveform portion B is started is set to the voice parameter of the tone generation of the sound source control system split I. FIGS. 10(*a*) and 10(*b*) depict these parameters and the fact that the waveform portion A and the waveform portion B are stored in noncontiguous areas of the waveform memory 18.

When the waveform portion B has not yet been transmitted to the waveform memory 18 and cannot be read out, a loop reproduction is carried out between the LOOP START ADDRESS of the waveform portion A (A-LOOP START) and the LOOP END ADDRESS of the waveform portion A (A-LOOP END). When the transmission of the waveform portion B from the hard disk 17 to the waveform memory 18 is started, each of the following settings is made in Step S18: the END ADDRESS of the waveform portion A (A-END) is set to the JUMP ORIGIN ADDRESS of the voice of the sound source control system 19 tone generation, the waveform portion B START ADDRESS (B-START) is set to the JUMP DESTINATION ADDRESS, and the waveform portion B LOOP END ADDRESS (B-LOOP END) is set to the LOOP END ADDRESS. By this means, since the LOOP END has changed during tone generation, the END ADDRESS of the waveform portion A (A-END) is reached and the processing jumps to the START ADDRESS of the waveform portion B (B-START). Even in those cases in which the LOOP END ADDRESS of the waveform portion B (B-LOOP END) has been reached, the processing temporarily returns to the LOOP START ADDRESS of the waveform portion A (A-LOOP START). That is to say, since the large loop reproduction of A-LOOP START, A-END, B-START, and B-LOOP END is carried out, the musical tone can be reproduced without interruption. Alternatively, the LOOP START ADDRESS of the voice during tone generation may be made the waveform portion B LOOP ADDRESS (B-LOOP START). Thus, the loop reproduction for the voice during the tone generation is carried out at the LOOP ADDRESS of the waveform portion B.

The explanation will be continued returning again to FIG. 9. In Step S19, it is determined whether or not the waveform portion B transmission for the split I has concluded. When it is determined that the transmission has not yet concluded, the routine returns to Step S19. On the other hand, when it has been determined that the waveform portion B transmission for the split I has concluded, the routine advances to Step S20.

In Step S20, it is determined whether or not the PUSH Flag is 1. In those cases in which it is determined that the PUSH Flag is 1, the routine advances to Step S21, the value I is taken from the stack and that value I is set in the counter. In addition, the PUSH Flag is reset to 0 and the routine returns to Step S12. On the other hand, in those cases in which it is determined that the PUSH Flag is 0, the routine advances to Step S22. In Step S22, it is determined whether or not transmission of waveform portion B has concluded. In those cases in which it is determined that transmission of waveform portion B has not yet concluded, the routine advances to Step S23, the value I is incremented by 1 and the routine returns to Step S12. On the other hand, in those cases in which it is determined that all of the waveform portion B transmission has concluded, the routine ends.

Figure 11:
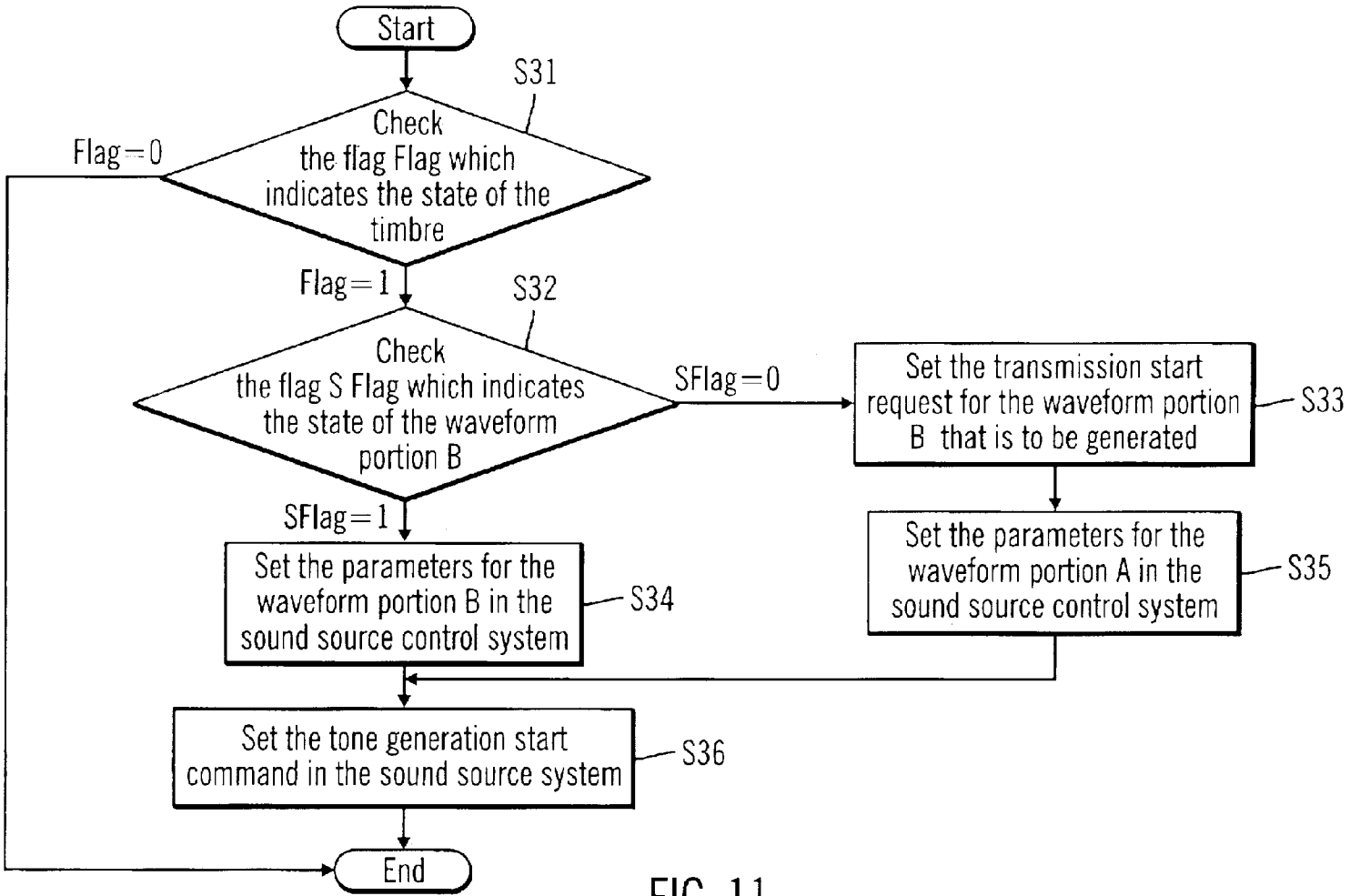
FIG. 11 is a flowchart of a sound generation request processing routine, according to embodiments of the present invention.

FIG. 11 is a flowchart of the tone generation request processing routine. This tone generation request processing routine is executed when NOTE ON information has been input by the keyboard 14 or the MIDI IN section 16.

First, in Step S31, the flag Flag, which indicates the state of the timbre is checked. In other words, it is determined whether or not the flag Flag is set to the value 1, which indicates the state in which the timbre parameter area has been transmitted to the RAM 13 and the waveform portion A has been transmitted to the waveform memory 18. When it is determined that the flag Flag has not been set to 1, since the tone generation processing cannot be carried out, this routine ends. On the other hand, when it is determined that the flag Flag has been set to 1, the routine advances to Step S32.

In Step S32, the flag S Flag is checked. The flag S Flag indicates the state of the waveform portion B transmission. When the waveform portion B has not been transmitted, a request is made to carry out the transmission of the waveform portion B with priority and, together with this, a tone is generated with the parameters of the waveform portion A. Specifically, in Step S32, it is determined whether or not the flag S Flag has been set to the value 1, which indicates the state in which the waveform portion B of the split that includes the note number of the NOTE ON information, has been transmitted and, therefore, that the waveform portion B tone generation is possible. When it is determined that the flag S Flag has been reset to 0, the routine advances to Step S33. In Step S33, the transmission start request for the waveform portion B that is generated is set and the routine advances to Step S35, which will be discussed later.

On the other hand, when, in Step S32, it is determined that the flag S Flag has been set to 1, the routine advances to Step S34. In Step S34, the waveform portion B parameters are set in the sound source control system 19. In detail, the waveform portion A END ADDRESS (A-END) is set to the JUMP ORIGIN ADDRESS of the voice of the sound source control system 19. In addition, the waveform portion B START ADDRESS (B-START) the waveform portion B START ADDRESS (B-START) is set to the JUMP DESTINATION ADDRESS in the sound source control system 19. Then, the waveform portion B START ADDRESS (B-START) is set to the JUMP DESTINATION ADDRESS, and the waveform portion B LOOP END ADDRESS (B-LOOP END) is set to the LOOP END ADDRESS in the sound source control system 19. By means of these parameter settings, the waveform reproduction is started from A-START, shifts to B-START when A-END is reached, and a loop reproduction is carried out between B-LOOP START and B-LOOP END, returning to B-LOOP START when B-LOOP END is reached.

In Step S35, the waveform portion A parameters are set in the sound source control system 19. Specifically, A-LOOP START and A-LOOP END are set in the sound source control system 19. By setting these parameters, the waveform reproduction is started from A-START, and a loop reproduction is carried out between A-LOOP START and A-LOOP END, returning to A-LOOP START when A-LOOP END is reached.

Next, in Step S36, the tone generation start command is set in the sound control system 19. Specifically, the tone generation is started from the first address of the waveform portion A. In this manner, the tone generation request processing is carried Out.

Incidentally, in this preferred embodiment, the transmission of the waveform portions A for all of the splits is carried out in Step S5 depicted in FIG. 8. However, in the same manner as the transmission of the waveform portions B, the transmission may be carried out giving the splits for which there is a tone generation request priority. In this case, the tone generation may be possible prior to the conclusion of the transmission of all of the waveform portion A splits.

In addition, in this preferred embodiment, the explanation was given with an illustration in which the timbre parameters and the waveform portions A are stored on the hard disk 17. However, the waveform portions A may also be stored in a ROM or other suitable memory device. By saving the timbre parameters and the waveform portions A in a ROM (the read-out speed is faster than that of a hard disk), the processing up to Step S6 can be carried out faster when switching the timbre. In other words, the time from switching the timbre until tone generation is possible may be reduced.

Furthermore, in this preferred embodiment, the explanation was given with an illustration in which the timbre parameters and the waveform portions A were only transmitted from the hard disk 17 during timbre selection. However, the transmission may also be done in a different manner. For example, the timbre parameters for all of the timbres and the waveform portions A may be transmitted when the power is turned on. Or, as another example, the timbre parameters used by the timbres that were selected in a previous session before the power was last removed, along with the waveform portions A, are transmitted when the power is again turned on. As another example, the timbre parameters used by the timbres that were selected in a specified previous session, along with the waveform portions A, are transmitted when the power is turned on. Or, the timbre parameters used for the timbres that have been given priority for transmission and the waveform portions A are transmitted when the power is turned on together with the provision of information regarding whether or not each timbre has been given priority for transmission.

In addition, in this preferred embodiment, the explanation was given with an illustration in which the waveform portions B are transmitted from the hard disk 17 only at the time of timbre selection. However, the transmission may also be done in cases such as those presented in the following. The waveform portions B that are used by the timbres that were selected in a previous session before power was last removed are transmitted when the power is turned on. Or, a log of the timbres that were selected is recorded and the waveform portions B used by the timbres that were selected in a specified previous session are transmitted when the power is turned on. Or, waveform portions B used for the timbres that have been given priority for transmission are transmitted when the power is turned on together with the provision of information regarding whether or not each timbre has been given priority for transmission.

In addition, in this preferred embodiment, the splits in which the timbre parameters and the waveform portions that are read out are switched are designated for the entire keyboard that has been divided into N key ranges. However, the range in which the velocity values are acquired may be divided into a number of ranges and the splits specified for each range. Also, the splits may be specified by a combination of these two methods.

In this preferred embodiment, the explanation was given with an illustration in which the timbre parameters and the waveform portions A and B are stored on a hard disk. However, the hard disk may be replaced with a large capacity storage medium such as, but not limited to, a NAND type flash memory or a flash EEPROM, that do not lend themselves to random access.

As has been explained above, in accordance with the present invention, it is possible to carry out the waveform reproduction without delays even in those cases in which the system is furnished with a disk device that has a comparatively slow access time.

Having disclosed exemplary embodiments and the best mode, modifications and variations may be made to the disclosed embodiments while remaining within the scope of the invention as defined by the following claims.

What is claimed is:

1. A waveform reproduction apparatus, comprising:

a first storaae section in which, from among waveform data that express musical tone waveforms, waveform data that express at least latter half portions of the musical tone waveforms are stored;

a second storage section in which waveform data that express first half portions of the musical tone waveforms are stored, a read-out speed of the second storage section being faster than a read-out sneed of the first storage section; and a processor programmed for controlling tone generation such that, in response to a tone generation start indicator, the waveform data that express ones of the first half portions corresponding to the tone generation start indicator that have been stored in the second storage section are successively read out and corresponding musical tone waveforms are formed, and following this, the waveform data that express ones of the latter half portions corresponding to the tone generation start indicator are successively read out and corresponding musical tone waveforms are formed, and such that if after the ones of the first half portions are successively read out and corresponding musical tone waveforms are formed, the read-out of the waveform data that express the ones of the latter half portions has not yet been started, the formation of the musical tone waveforms is based on a specified segment that has been set in the waveform data;

wherein the specified segment has been set in the waveform data that express the ones of the first half portions.

2. A waveform reproduction apparatus, comprising:

a first storage section in which, from among waveform data that express musical tone waveforms, waveform data that express at least latter half portions of the musical tone waveforms are stored;

a second storage section in which waveform data that express first half portions of the musical tone waveforms are stored, a read-out speed of the second storage section being faster than a read-out speed of the first storage section; and a processor programmed for controlling tone generation such that, in response to a tone generation start indicator, the waveform data that express ones of the first half portions corresponding to the tone generation start indicator that have been stored in the second storage section are successively read out and corresponding musical tone waveforms are formed, and following this, the waveform data that express ones of the latter half portions corresponding to the tone generation start indicator are successively read out and corresponding musical tone waveforms are formed, and such that if after the ones of the first half portions are successively read out and corresponding musical tone waveforms are formed, the read-out of the waveform data that express the ones of the latter half portions has not yet been started, the formation of the musical tone waveforms is based on a specified segment that has been set in the waveform data;

wherein if after the ones of the first half portions are successively read out and corresponding musical tone waveforms are formed, the read-out of the waveform data that express the ones of the latter half portions has been started, the formation of the musical tone waveforms is based on a specified segment that has been set in the waveform data that express both the ones of the first half portions and the ones of the second half portions.

3. A waveform reproduction apparatus, comprising:

a first storage section in which, from among waveform data that express musical tone waveforms, waveform data that express at least latter half portions of the musical tone waveforms are stored;

a second storage section in which waveform data that express first half portions of the musical tone waveforms are stored, a read-out sneed of the second storage section being faster than a read-out speed of the first storage section; and a processor programmed for controlling tone generation such that, in response to a tone generation start indicator, the waveform data that express ones of the first half portions corresponding to the tone generation start indicator that have been stored in the second storage section are successively read out and corresponding musical tone waveforms are formed, and following this, the waveform data that express ones of the latter half portions corresponding to the tone generation start indicator are successively read out and corresponding musical tone waveforms are formed, and such that if after the ones of the first half portions are successively read out and corresponding musical tone waveforms are formed, the read-out of the waveform data that express the ones of the latter half portions has not yet been started, the formation of the musical tone waveforms is based on a specified segment that has been set in the waveform data;

wherein if after the ones of the first half portions are successively read out and corresponding musical tone waveforms are formed, the read-out of the waveform data that express the ones of the latter half portions has been started, the formation of the musical tone waveforms is based on a specified segment that has been set in the waveform data that express the ones of the second half portions.

4. A waveform reproduction apparatus, comprising:

a first storage section in which, from among waveform data that express musical tone waveforms, waveform data that express at least latter half portions of the musical tone are stored;

a second storage section in which waveform data that express first half portions of the musical tone waveforms are stored, a read-out speed of the second storage section being faster than a read-out speed of the first storage section; and a processor programmed for controlling tone generation such that, in response to a tone generation start indicator, the waveform data that express ones of the first half portions corresponding to the tone generation start indicator that have been stored in the second storage section are successively read out and corresponding musical tone waveforms are formed, and following this, the waveform data that express ones of the latter half portions corresponding to the tone generation start indicator are successively read out and corresponding musical tone waveforms are formed, and such that if after the ones of the first half portions are successively read out and corresponding musical tone waveforms are formed, the read-out of the waveform data that express the ones of the latter half portions has not yet been started, the formation of the musical tone waveforms is based on a specified segment that has been set in the waveform data;

wherein waveform data that express the ones of the latter half portions of the musical tone waveforms are transmitted with priority.

5. A waveform reproduction apparatus, comprising:

a first storage section in which, from among waveform data that express musical tone waveforms, waveform data that express at least latter half portions of the musical tone waveforms are stored;

a second storage section in which waveform data that express first half portions of the musical tone waveforms are stored, a read-out speed of the second storage section being faster than a read-out speed of the first storage section; and a processor programmed for controlling tone generation such that, in response to a tone generation start indicator, the waveform data that express ones of the first half portions corresponding to the tone generation start indicator that have been stored in the second storage section are successively read out and corresponding musical tone waveforms are formed, and following this, the waveform data that express ones of the latter half portions corresponding to the tone generation start indicator are successively read out and corresponding musical tone waveforms are formed, and such that if after the ones of the first half portions are successively read out and corresponding musical tone waveforms are formed, the read-out of the waveform data that express the ones of the latter half portions has not yet been started, the formation of the musical tone waveforms is based on a specified segment that has been set in the waveform data;

wherein the first storage section is at least one of a magnetic recording medium, a Read Only Memory (ROM), a NAND type flash memory and a flash Electronically Erasable Programmable ROM (EEPROM).

6. The apparatus recited in claim 1, wherein the second storage section is a Random Access Memory (RAM).

7. A waveform reproduction apparatus, comprising:

a first storage section in which waveform data that express first half portions and waveform data that express latter half portions of waveform data that express a plurality of musical tone waveforms are stored;

a second storage section having a faster read-out speed than a read-out speed of the first storage section;

a processor programmed for:

transmitting the waveform data such that, for the transmission of the waveform data from the first storage section to the second storage section, the waveform data that express the latter half portions of all of the plurality of musical tone waveforms are transmitted after the waveform data that express the first half portions of all of the plurality of musical tone waveforms have been transmitted; and controlling tone generation such that, in response to a tone generation start indicator, the waveform data that express ones of the first half portions corresponding to the tone generation start indicator are read out and corresponding musical tone waveforms are formed, and following this, the waveform data that express ones of the latter half portions corresponding to the tone generation start indicator are read out and corresponding musical tone waveforms are formed, and such that under conditions wherein the ones of the first half portions are read out and corresponding musical tone waveforms are formed and the read-out of waveform data that express the ones of the latter half portions has not yet begun, the formation of the musical tone waveforms is determined by a specified segment in the waveform data.

8. The apparatus recited in claim 7, wherein the specified segment is part of the waveform data that express the ones of the first half portions.

9. The apparatus recited in claim 7, wherein waveform data that express the ones of the latter half portions of the musical tone waveforms are transmitted with priority.

10. A waveform reproduction apparatus, comprising:

a first storage section in which waveform data that express latter half portions of a plurality of musical tone waveforms are stored;

a second storage section in which waveform data that express first half portions of the plurality of musical tone waveforms are stored, the second storage section having a faster read-out speed than a read-out speed of the first storage section;

a processor programmed for:

transmitting the waveform data that have been stored in the first storage section to the second storage section; and controlling tone generation such that, in response to a tone generation start indicator, the waveform data that express ones of the first half portions corresponding to the tone generation start indicator are successively read out and corresponding musical tone waveforms are formed, and following this, the waveform data that express ones of the latter half portions corresponding to the tone generation start indicator are successively read out and corresponding musical tone waveforms are formed, and such that under conditions wherein after the ones of the first half portions are successively read out and corresponding musical tone waveforms are formed, the read-out of the waveform data that express the ones of the latter half portions has not yet started, a pre-determined segment of the waveform data determines the formation of the musical tone waveforms.

11. The apparatus recited in claim 10, wherein the predetermined segment is set in the waveform data that express the ones of the first half portions.

12. The apparatus recited in claim 10, wherein waveform data that express the ones of the latter half portions of the musical tone waveforms are transmitted with priority.

13. A waveform reproduction apparatus, comprising:

a first storage section in which, from among waveform data that express musical tone waveforms, waveform data that express at least latter half portions of the musical tone waveforms are stored;

a second storage section in which waveform data that express first half portions of the musical tone waveforms are stored, a read-out speed of the second storage section being faster than a read-out speed of the first storage section;

software instructions for controlling tone generation such that, in response to a tone generation start indicator, the waveform data that express ones of the first half portions corresponding to the tone generation start indicator that have been stored in the second storage section are successively read out and corresponding musical tone waveforms are formed, and following this, the waveform data that express ones of the latter half portions corresponding to the tone generation start indicator are successively read out and corresponding musical tone waveforms are formed, and such that under conditions wherein if the ones of the first half portions are successively read out and corresponding musical tone waveforms are formed and the read-out of the waveform data that express the ones of the latter half portions has not begun, the formation of the musical tone waveforms is based on a specified segment that has been set in the waveform data; and a processor configured to execute the software instructions wherein the specified segment has been set in the waveform data that express the ones of the first half portions.

14. A waveform reproduction apparatus, comprising:

a first storage section in which waveform data that express first half portions and waveform data that express latter half portions of waveform data that express a plurality of musical tone waveforms are stored;

a second storage section having a faster read-out speed than a read-out speed of the first storage section;

software instructions adapted for:

transmitting the waveform data from the first storage section to the second storage section such that the waveform data expressing the latter half portions of all of the plurality of musical tone waveforms are transmitted after the waveform data that express the first half portions of all of the plurality of musical tone waveforms have been transmitted; and controlling tone generation such that, in response to a tone generation start indicator, the waveform data that express ones of the first half portions corresponding to the tone generation start indicator are successively read out and corresponding musical tone waveforms are formed, and following this, the waveform data that express ones of the latter half portions corresponding to the tone generation start indicator are successively read out and corresponding musical tone waveforms are formed, and such that after the ones of the first half portions are successively read out and corresponding musical tone waveforms are formed, the read-out of the waveform data that express the ones of the latter half portions has not yet begun, the formation of the musical tone waveforms is determined by a specified segment in the waveform data expressing the ones of the first half portions; and a processor configured for executing the software instructions.

15. A waveform reproduction apparatus, comprising:

a first storage section in which waveform data that express latter half portions of a plurality of musical tone waveforms are stored;

a second storage section in which waveform data that express first half portions of the plurality of musical tone waveforms are stored, the second storage section having a faster read-out speed than a read-out speed of the first storage section;

transmission means for transmitting the waveform data stored in the first storage section to the second storage section; and control means for controlling tone generation such that, in response to a tone generation start indicator, the waveform data that express ones of the first half portions corresponding to the tone generation start indicator are successively read out and corresponding musical tone waveforms are formed, and following this, the waveform data that express ones of the latter half portions corresponding to the tone generation start indicator are successively read out and corresponding musical tone waveforms are formed, and such that under conditions wherein after the ones of the first half portions are successively read out and corresponding musical tone waveforms are formed, the read-out of the waveform data that express the ones of the latter half portions has not yet been started, the formation of the musical tone waveforms is based on a specified segment that has been set in the waveform data that express the ones of the first half portions.

16. A method for waveform reproduction, comprising:

storing in a first storage section waveform data that express at least latter half portions of musical tone waveforms;

storing in a second storage section waveform data that express first half portions of the musical tone waveforms, a read-out speed of the second storage section being faster than a read-out speed of the first storage section; and controlling tone generation such that, in response to a tone generation start indicator, the waveform data that express ones of the first half portions corresponding to the tone generation start indicator that have been stored in the second storage section are successively read out and corresponding musical tone waveforms are formed, and following this, the waveform data that express ones of the latter half portions corresponding to the tone generation start indicator are successively read out and corresponding musical tone waveforms are formed;

wherein if after the ones of the first half portions have been successively read out and corresponding musical tone waveforms have been formed, the read-out of the waveform data that express the ones of the latter half portions has not yet begun, the formation of the musical tone waveforms is based on a specified segment in the waveform data.

17. The method recited in claim 16, wherein the specified segment has been set in the waveform data that express the ones of the first half portions.

18. The method recited in claim 16, wherein waveform data that express the ones of the latter half portions of the musical tone waveforms are transmitted with priority.

* * * * *